US008892019B2

(12) United States Patent
Hirayama et al.

(10) Patent No.: US 8,892,019 B2
(45) Date of Patent: Nov. 18, 2014

(54) IMAGE FORMING APPARATUS AND GLOSS CONTROL METHOD

(71) Applicants: Junya Hirayama, Takarazuka (JP); Shigeo Uetake, Takatsuki (JP); Yuji Kamoda, Ibaraki (JP); Toshiya Natsuhara, Takarazuka (JP)

(72) Inventors: Junya Hirayama, Takarazuka (JP); Shigeo Uetake, Takatsuki (JP); Yuji Kamoda, Ibaraki (JP); Toshiya Natsuhara, Takarazuka (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 52 days.

(21) Appl. No.: 13/836,633

(22) Filed: Mar. 15, 2013

(65) Prior Publication Data

US 2013/0243503 A1 Sep. 19, 2013

(30) Foreign Application Priority Data

Mar. 19, 2012 (JP) ..... 2012-061838

(51) Int. Cl.
*G03G 15/20* (2006.01)
*G03G 15/00* (2006.01)

(52) U.S. Cl.
CPC ..... *G03G 15/2075* (2013.01); *G03G 15/6585* (2013.01); *G03G 2215/00805* (2013.01); *G03G 15/2021* (2013.01)
USPC ..... 399/341; 399/333; 399/54; 399/122; 399/67

(58) Field of Classification Search
USPC ..... 399/67, 122, 320, 341, 223, 15, 228, 399/333, 49
See application file for complete search history.

(56) References Cited

U.S. PATENT DOCUMENTS

2005/0135823 A1* 6/2005 Ng ..... 399/49
2005/0219641 A1 10/2005 Kitano et al.
2012/0177426 A1* 7/2012 Fujita et al. ..... 399/341

FOREIGN PATENT DOCUMENTS

JP 64-029887 A 1/1989
JP 2005-284048 A 10/2005
JP 2008-090114 A 4/2008
JP 2010-262103 A 11/2010

OTHER PUBLICATIONS

Office Action (Notice of Grounds of Rejection) issued on Jan. 21, 2014, by the Japanese Patent Office in corresponding Japanese Patent Application No. 2012-061838, and an English Translation of the Office Action. (5 pages).
Japanese Decision to Grant dated Sep. 30, 2014 issued in corresponding Japanese Patent Appln. 2012-061838 with English translation (6 pages).

* cited by examiner

*Primary Examiner* — Walter L Lindsay, Jr.
*Assistant Examiner* — Roy Y Yi
(74) *Attorney, Agent, or Firm* — Buchanan Ingersoll & Rooney PC

(57) ABSTRACT

An image forming apparatus for forming an image on a recording medium includes a fixing unit configured to fix on a recording medium, a toner image formed on the recording medium, through heating and pressurization and a gloss control unit configured to lower gloss of a surface of the toner image by charging the surface of the toner image fixed onto the recording medium and heating the toner image such that toner contained in the toner image reaches a softening point or higher thereof.

8 Claims, 2 Drawing Sheets

| | THE NUMBER OF OPERATING HEATERS | | |
|---|---|---|---|
| | ONE | TWO | THREE |
| CHARGER ON | 85 | 70 | 60 |
| CHARGER OFF | 85 | 85 | 87 |
| TEMPERATURE OF TONER IMAGE (°C) | 125 | 180 | 195 |

IMAGE FORMING APPARATUS AND GLOSS CONTROL METHOD

This application is based on Japanese Patent Application No. 2012-061838 filed with the Japan Patent Office on Mar. 19, 2012, the entire content of which is hereby incorporated by reference.

BACKGROUND OF THE INVENTION

1. Field of the Invention

The present invention relates to an image forming apparatus and a gloss control method, and particularly to an image forming apparatus for forming an image on a recording medium with electrophotography and a gloss control method for controlling gloss of an image formed on a recording medium with electrophotography.

2. Description of the Related Art

An image forming apparatus for forming an image on a recording medium with electrophotography has been known. Types of recording media on which an image is to be formed have recently been various. For example, bond paper has fine projections and recesses at its surface owing to a material therefor (paper fiber). Meanwhile, coated paper has a smooth surface shape because a coating layer is formed on its surface. Since bond paper and coated paper are different in surface shape from each other, they are different in gloss (glossiness) from each other.

In forming an image (a toner image) on a recording medium, depending on difference between gloss of a portion where an image is formed (an image portion) and gloss of a background portion of a recording medium where no image is formed (a non-image portion), a user may feel disagreeable. In general, gloss of an image formed on a recording medium should be set not to have a user feel disagreeable, depending on a type of a recording medium. On the other hand, there is also a case where difference in gloss is intentionally set between an image portion and a non-image portion and the difference in gloss is utilized as means for improving added value of an output image.

Japanese Laid-Open Patent Publication No. 64-029887 discloses a fixing apparatus in which selection between providing gloss to an image and not providing gloss to an image is made by changing a temperature for fixing an image.

SUMMARY OF THE INVENTION

Toner used in an image forming apparatus in which electrophotography has been adopted includes particles in which pigments have been dispersed in a binder. In order to ensure appropriate image density and fixing strength, a certain amount or more of toner should adhere onto a recording medium. In fixing a certain amount or more of toner which has adhered onto a recording medium through heating and pressurization, an individual toner particle is molten on the recording medium.

The molten toner particles are pressurized by a pressure roller to thereby cover projections and recesses at the surface of the recording medium and form a film-like thin layer having a smooth surface. Therefore, in a general image forming apparatus in which electrophotography is adopted, gloss of a toner image formed on a recording medium tends to be high, owing to a point of view of ensuring appropriate image density and fixing strength.

In contrast, the fixing apparatus disclosed in Japanese Laid-Open Patent Publication No. 64-029887 has such a feature that a sufficient amount of heat is not provided to a toner image in a fixing step in order to lower gloss of the toner image. Since individual toner particles cannot completely be molten in the fixing step, projections and recesses attributed to the presence of toner particles remain at the surface of the toner image. Consequently, the surface of the toner image fixed onto the recording medium by the fixing apparatus is formed to have projections and recesses, so that incident light is scattered. Using this principle, the fixing apparatus achieves low gloss of the toner image.

With this fixing apparatus, however, an amount of heat provided to a toner image for lowering gloss of the toner image is insufficient and strength of fixing the toner image to the recording medium is insufficient. Namely, in a conventional image forming apparatus in which electrophotography is adopted, it has been difficult to achieve both of lowering in gloss of a toner image and ensured strength of fixing of a toner image to a recording medium.

The present invention was made in view of such circumstances, and an object thereof is to obtain an image forming apparatus and a gloss control method capable of lowering gloss of a toner image while fixing strength is ensured.

An image forming apparatus according to the present invention is an image forming apparatus for forming an image on a recording medium conveyed along a prescribed conveyance direction, and includes a fixing unit configured to fix on the recording medium, a toner image formed on the recording medium, through heating and pressurization, and a gloss control unit configured to lower gloss of a surface of the toner image by charging the surface of the toner image fixed onto the recording medium and heating the toner image such that toner contained in the toner image reaches a softening point or higher thereof.

Preferably, the gloss control unit includes a charging unit configured to charge the surface of the toner image and a heating unit configured to heat the toner image which is arranged downstream of the charging unit in the conveyance direction. Preferably, the charging unit has a corona charger for charging the surface of the toner image without contacting the surface of the toner image. Preferably, the heating unit has a light source for radiating infrared rays or far-infrared rays, and the light source heats the toner image without contacting the surface of the toner image.

A gloss control method according to the present invention includes a fixing step of fixing on a recording medium, a toner image formed on the recording medium, through heating and pressurization, and a gloss control step of lowering gloss of a surface of the toner image by charging the surface of the toner image fixed onto the recording medium and heating the toner image such that toner contained in the toner image reaches a softening point or higher thereof.

Preferably, the gloss control step includes a charging step of charging the surface of the toner image and a heating step of heating the toner image after the charging step. Preferably, in the charging step, a corona charger for charging the surface of the toner image without contacting the surface of the toner image is employed. Preferably, in the heating step, a light source for radiating infrared rays or far-infrared rays is employed, and the light source heats the toner image without contacting the surface of the toner image.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
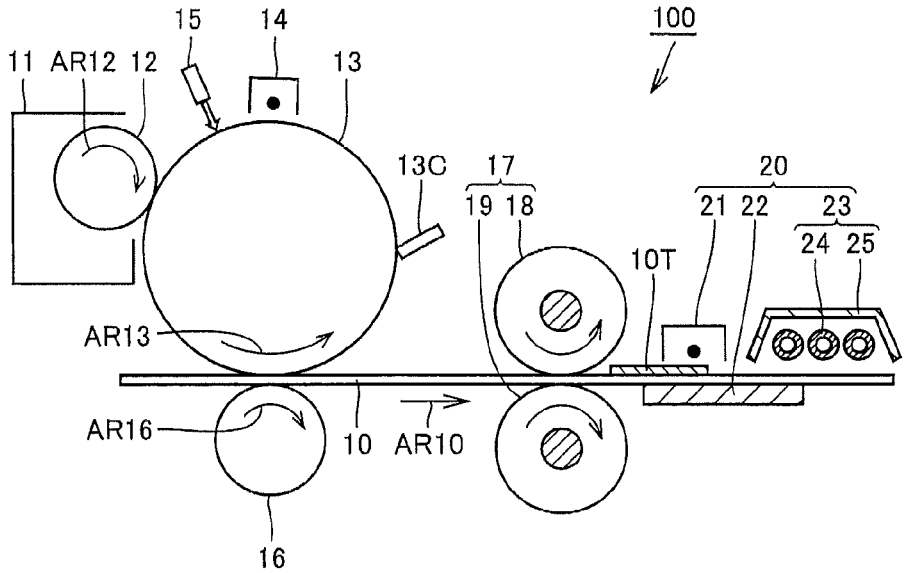
FIG. 1 is a diagram schematically showing an image forming apparatus in a first embodiment.

Each embodiment according to the present invention will be described hereinafter with reference to the drawings. When the number, an amount or the like is mentioned in the description of each embodiment, the scope of the present invention is not necessarily limited to the number, the amount or the like, unless otherwise specified. In the description of each embodiment, the same or corresponding elements have the same reference characters allotted and redundant description may not be repeated.

[First Embodiment]

(Image Forming Apparatus 100)

An image forming apparatus 100 and a gloss control method in the present embodiment will be described with reference to FIG. 1. Image forming apparatus 100 includes a development apparatus 11, a photoconductor 13, a charging apparatus 14, an exposure apparatus 15, a cleaning apparatus 13C, a transfer roller 16, fixing means 17, and gloss control means 20. Image forming apparatus 100 forms an image on a recording medium 10 conveyed along a prescribed conveyance direction (a direction shown with an arrow AR10) with electrophotography.

Photoconductor 13 rotates in a direction shown with an arrow AR13. Development apparatus 11 has a development roller 12 rotating in a direction shown with an arrow AR12 while abutting to photoconductor 13. Charging apparatus 14, exposure apparatus 15, development apparatus 11 (development roller 12), transfer roller 16, and cleaning apparatus 13C are sequentially arranged along a direction of rotation (the direction shown with arrow AR13) of photoconductor 13.

A surface of photoconductor 13 is uniformly charged by charging apparatus 14. Exposure apparatus 15 has a laser oscillator and the like. The surface of photoconductor 13 is irradiated with laser from exposure apparatus 15 based on a prescribed image signal. The surface of photoconductor 13 is exposed and an electrostatic latent image based on the prescribed image signal is formed on the surface of photoconductor 13.

Development roller 12 of development apparatus 11 develops (visualizes) this electrostatic latent image as a toner image by using a developer containing toner. Though a single development apparatus 11 is employed in image forming apparatus 100 in the present embodiment, a plurality of development apparatuses 11 are employed in the case of forming a toner image as a color image on photoconductor 13.

(Developer)

For a developer supplied from development roller 12 of development apparatus 11 to an electrostatic latent image on photoconductor 13, for example, an agent in which a coloring agent and a charge control agent or a release agent or the like as necessary are contained in a binder resin and an external additive is further added thereto can be employed. A toner particle preferably has a particle size approximately from 3 μm to 15 μm. Such toner can be manufactured, for example, with a crushing method, an emulsion polymerization method, a suspension polymerization method, or the like.

For a binder resin used for toner, for example, a styrene-based resin (styrene or a homopolymer or a copolymer containing a styrene substitution product), a polyester resin, a polyethylene resin, or the like can be employed. For a coloring agent used for toner, for example, aniline black, benzine yellow, permanent yellow, naphtol yellow, phthalocyanine blue, fast sky blue, ultramarine blue, rose bengal, lake red, or the like can be employed.

A coloring agent is preferably used in a ratio of 2 to 20 parts by mass with respect to 100 parts by mass of a binder resin. In using a charge control agent, a charge control agent is preferably used in a ratio of 0.1 to 10 part(s) by mass with respect to 100 parts by mass of a binder resin. In using a release agent, for example, polyethylene, polypropylene, or the like can be employed for a release agent. A release agent is preferably used in a ratio of 0.1 to 10 part(s) by mass with respect to 100 parts by mass of a binder resin.

For an external additive, for example, an agent. obtained by making inorganic fine particles of silica, titanium oxide, aluminum oxide, or the like hydrophobic with the use of a silane coupling agent, a titanium coupling agent, a silicone oil, or the like is preferably employed. Such an external additive (a fluidizing agent) is used such that it is added in a ratio of 0.1 to 5 part(s) by mass with respect to 100 parts by mass of toner. An external additive has a number average primary particle size preferably from 10 nm to 100 nm.

(Transfer Portion)

A transfer portion is formed between photoconductor 13 and transfer roller 16 rotating in a direction shown with an arrow AR16. Recording medium 10 is conveyed in a direction shown with arrow AR10 so as to pass this transfer portion. When recording medium 10 passes this transfer portion, a toner image on photoconductor 13 is transferred to a surface of recording medium 10 as a transfer bias is applied. A toner image which remained on photoconductor 13 without being transferred onto recording medium 10 is removed from the surface of photoconductor 13 by cleaning apparatus 13C.

In image forming apparatus 100 in the present embodiment, the toner image on photoconductor 13 is transferred from photoconductor 13 onto recording medium 10. The toner image on photoconductor 13 may once be transferred to an intermediate transfer roller or an intermediate transfer belt (which is not shown) and thereafter transferred onto recording medium 10. After the toner image is transferred onto recording medium 10, recording medium 10 is further conveyed in the direction shown with arrow AR10 toward fixing means 17.

(Gloss Control Method)

The gloss control method in the present embodiment includes a fixing step and a gloss control step. Fixing means 17 used in the fixing step has a fixing roller 18 and a pressure roller 19. A pressure-contact nip portion is formed between fixing roller 18 and pressure roller 19. A path for conveyance of recording medium 10 is provided to pass this pressure-contact nip portion. When recording medium 10 passes this pressure-contact nip portion, a toner image on recording medium 10 is fixed onto recording medium 10 through pressurization and heating (fixing step). After the toner image is fixed onto recording medium 10, recording medium 10 is further conveyed in the direction shown with arrow AR10 toward gloss control means 20.

(Gloss Control Step)

Gloss control means 20 used in the gloss control step has charging means 21, an electrode 22, and heating means 23. Charging means 21 is located downstream of fixing means 17 in the direction of conveyance of recording medium 10 and arranged on a side of a recording surface of recording medium 10 where a toner image 10T is formed.

For charging means 21, a corona charger or the like capable of charging a surface of a toner image without contacting the surface of the toner image fixed onto recording medium 10 is employed. A roller, a blade, or the like to which a high voltage is applied may be employed as charging means 21. In this case, a construction may be such that charging means 21 is brought into contact with toner image 10T to thereby charge toner image 10T.

Electrode 22 is located downstream of fixing means 17 in the direction of conveyance of recording medium 10 and arranged opposite to the recording surface of recording medium 10 on which toner image 10T is formed. Electrode 22 is arranged to substantially be opposed to charging means 21 and grounded to be set to a ground potential. Toner image 10T formed on recording medium 10 passes between charging means 21 and electrode 22. Here, a capacitance is formed between a surface of toner image 10T and electrode 22 as a result of a discharge function of charging means 21. The surface of toner image 10T is charged and charges are accumulated at the surface of toner image 10T (charging step).

Heating means 23 is located downstream of charging means 21 in the direction of conveyance of recording medium 10 and arranged on the side of the recording surface of recording medium 10 on which toner image 10T is formed. Heating means 23 has a non-contact heater 24 and a reflector 25. Non-contact heater 24 heats toner image 10T fixed onto recording medium 10 from the side of the recording surface of recording medium 10 without contacting toner image 10T (heating step).

A light source for radiating a long wavelength (far-infrared rays) such as a ceramic heater is desirably employed as non-contact heater 24. For non-contact heater 24, a light source radiating infrared or near-infrared rays such as a flash lamp may be employed or a component capable of blowing warm air to heat toner image 10T may be employed.

Reflector 25 is provided to cover non-contact heater 24. Reflector 25 holds a temperature around non-contact heater 24 at a high temperature, so that efficiency in heating by non-contact heater 24 can be improved. A material having a high heat insulating property and a high heat resistant property such as ceramic fibers is desirably employed for reflector 25.

After the surface of toner image 10T is charged by charging means 21, recording medium 10 is further conveyed in the direction shown with arrow AR10 toward heating means 23. Heating means 23 heats toner image 10T such that toner contained in toner image 10T reaches a softening point (for example, 140° C.) or higher thereof. As a result of heating, the surface (a surface layer) of toner image 10T is molten.

When the surface of toner image 10T is molten, charges are present at the surface of toner image 10T. These charges sink toward recording medium 10 (to the side where electrode 22 is arranged), together with the molten resin present at the surface (surface layer) of toner image 10T. Consequently, small irregularities are formed at the surface of toner image 10T, and the surface of toner image 10T exhibits projections and recesses. The surface of toner image 10T can scatter incident light and thus gloss of toner image 10T lowers.

Depending on a type of charging means 21 and heating means 23, a resistance value of toner image 10T may be lowered by an additive dispersed in a resin for toner so that it may be less likely that charges are accumulated at the surface of toner image 10T. In this case, desirably, a distance between charging means 21 and heating means 23 is decreased and a time period from charging to heating is minimized, so that charges are satisfactorily accumulated at the surface of toner image 10T.

(Function and Effect)

As described above, even though a fixing temperature (a temperature for heating toner image 10T) in fixing means 17 is set to such a value as providing an amount of heat capable of obtaining sufficient fixing strength to toner image 10T, an image low in gloss can be obtained owing to the function of gloss control means 20. Therefore, according to image forming apparatus 100 and the gloss control method in the present embodiment, gloss of a toner image can be lowered while fixing strength is ensured.

[Second Embodiment]

(Image Forming Apparatus 200)

Figure 2:
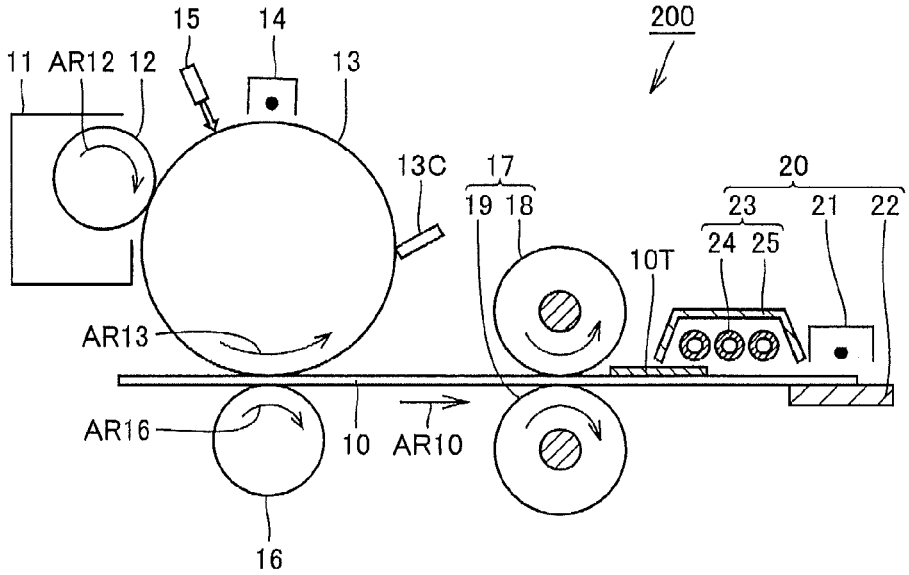
FIG. 2 is a diagram schematically showing an image forming apparatus in a second embodiment.

Referring to FIG. 2, in an image forming apparatus 200 in the present embodiment, heating means 23 is located upstream of charging means 21 in the direction of conveyance of recording medium 10. According to the construction as well, a function and effect substantially the same as in the first embodiment described above can be obtained.

In image forming apparatus 200, immediately after recording medium 10 passes heating means 23, a temperature of toner image 10T lowers and the surface of toner image 10T starts to be cured. Therefore, desirably, a construction is such that charging means 21 is arranged as close as possible to heating means 23 and a molten state of toner image 10T can be held as long as possible until toner image 10T reaches charging means 21.

EXPERIMENTAL EXAMPLE

Figures 3, 4:
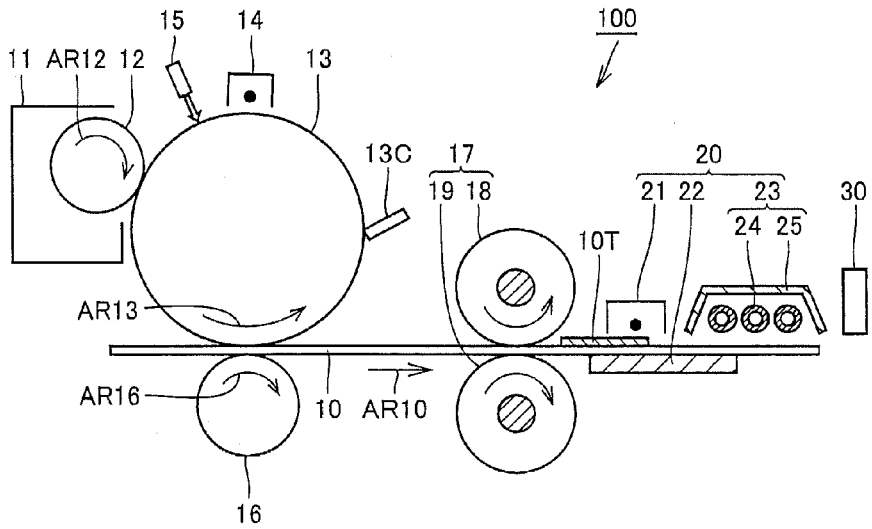
FIG. 3 is a diagram schematically showing an image forming apparatus in an example of an experiment conducted in connection with the first embodiment.
FIG. 4 is a diagram showing results in the example of the experiment conducted in connection with the first embodiment.

An example of an experiment conducted in connection with image forming apparatus 100 and the gloss control method in the first embodiment described above will be described with reference to FIGS. 3 and 4. FIG. 3 is a diagram schematically showing a construction of image forming apparatus 100 employed in the present experimental example.

As an overall construction of image foil ling apparatus 100 employed in the present experimental example, a construction equivalent to a color printer manufactured by Konica Minolta Business Solutions Japan Co., Ltd. (magicolor 2300) was employed. A system speed of image forming apparatus 100 employed in the present experimental example was set to 100 mm/sec. Cyan toner for this color printer was employed as toner serving as a developer.

A corona charger (a charger of a corotron type) was employed as charging means 21. A voltage applied by the corona charger was set to 5.5 kV. A sink current from the corona charger was measured as a current which flowed through electrode 22, and it was approximately 80 μA. A far-infrared heater with reflector manufactured by Kawai Electric Heater Co., Ltd. (A-1-1000 of a 1000 W type) was employed as heating means 23. This far-infrared heater had three far-infrared heaters as non-contact heaters 24. A power supply for the three far-infrared heaters was configured to be able to switch ON/OFF independently of one another.

A temperature sensor 30 was further arranged downstream of heating means 23. A temperature sensor manufactured by Keyence Corporation (FT-H20) was employed as temperature sensor 30. This temperature sensor is of a thermopile type for sensing an amount of infrared rays radiated from toner image 10T on recording medium 10 and it is capable of measuring a temperature of toner image 10T immediately after it passed heating means 23.

Toner image 10T (a patch image) in cyan having a size of 30 mm×30 mm was formed on recording medium 10 and fixed onto recording medium 10. Here, an amount of adhering toner after fixing on recording medium 10 was measured and it was 7 g/m2. In the case where gloss control means 20 was not operated at the time when recording medium 10 passed gloss control means 20, glossiness of toner image 10T formed as an output image on recording medium 10 was 85. This glossiness is a value measured with a gloss meter manufactured by Nippon Denshoku Industries Co., Ltd. (VG-200).

Referring to FIG. 4, when recording medium 10 passes gloss control means 20 under the conditions set as above, gloss control means 20 was operated. Specifically, in each case of setting the charger serving as charging means 21 to ON and OFF, glossiness of toner image 10T formed as an output image on recording medium 10 was measured, with the number of operating non-contact heaters 24 being varied from 1 to 3. This glossiness is again a value measured with a gloss meter manufactured by Nippon Denshoku Industries Co., Ltd. (VG-200) similarly to the above.

(Charger ON)

In the case where the charger serving as charging means 21 was set to ON and only a single non-contact heater 24 was operated, glossiness of toner image 10T formed as an output image was 85. This value is the same as the value in the case where gloss control means 20 was not operated at the time when recording medium 10 passed gloss control means 20. Namely, it can be seen that, even when the charger serving as charging means 21 is set to ON, heating with a single non-contact heater 24 does not lower gloss of toner image 10T.

A cause for this is considered as follows. Output from prepared non-contact heater 24 was not sufficient as an amount of heating of toner image 10T, a temperature of toner image 10T measured with temperature sensor 30 was 125° C., and toner contained in toner image 10T did not reach a softening point (140° C.) or higher thereof.

Measurement of a softening point of toner contained in toner image 1 OT was conducted as follows, with the use of a flow tester (capillary rheometer) manufactured by Shimadzu Corporation (CFT-500D). While 1 g of toner sample was heated at a temperature increase rate of 6° C/minute, a plunger was used to apply load of 1.96 MPa to thereby extrude the toner sample from a nozzle having a diameter of 1 mm and a length of 1 mm. Thus, a curve showing relation between an amount of lowering of the plunger (a flow value) of the flow tester and a temperature was drawn, and a temperature corresponding to h/2 where h represents a height of that S-shaped curve (a temperature at which half of a resin flowed out) was defined as a softening point. Consequently, a softening point of toner contained in used toner image 10T was found to be 140° C.

On the other hand, in the case where the charger serving as charging means 21 was set to ON and two non-contact heaters 24 were operated, glossiness of toner image 10T formed as an output image was 70. A temperature of toner image 10T measured with temperature sensor 30 was 180° C., and it can be seen that toner contained in toner image 10T reached a softening point (140° C.) or higher thereof and gloss of toner image 10T lowered.

In the case where the charger serving as charging means 21 was set to ON and three non-contact heaters 24 were operated, glossiness of toner image 10T foamed as an output image was 60. A temperature of toner image 10T measured with temperature sensor 30 was 195° C., and it can be seen that toner contained in toner image 10T reached a softening point (140° C.) or higher thereof and gloss of toner image 10T lowered.

(Charger OFF)

On the other hand, in the case where the charger serving as charging means 21 was set to OFF, even when one to three non-contact heater(s) 24 was (were) operated, gloss of toner image 10T formed as an output image did not lower. Therefore, it can be seen that gloss of toner image 10T can be lowered by appropriately operating charging means 21 and heating means 23 in accordance with a softening point or the like of toner contained in toner image 10T.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus for forming an image on a recording medium conveyed along a prescribed conveyance direction, comprising:

a fixing unit configured to fix on said recording medium, a toner image formed on said recording medium, through heating and pressurization; and a gloss control unit configured to lower gloss of a surface of said toner image by charging the surface of said toner image fixed onto said recording medium and heating said toner image such that toner contained in said toner image reaches a softening point or higher thereof.

2. The image forming apparatus according to claim 1, wherein said gloss control unit includes a charging unit configured to charge the surface of said toner image and a heating unit configured to heat said toner image which is arranged downstream of said charging unit in said conveyance direction.

3. The image forming apparatus according to claim 2, wherein said charging unit has a corona charger for charging the surface of said toner image without contacting the surface of said toner image.

4. The image forming apparatus according to claim 2, wherein said heating unit has a light source for radiating infrared rays or far-infrared rays, and said light source heats said toner image without contacting the surface of said toner image.

5. A gloss control method, comprising:

a fixing step of fixing on a recording medium, a toner image formed on said recording medium, through heating and pressurization; and a gloss control step of lowering gloss of a surface of said toner image by charging the Surface of said toner image fixed onto said recording medium and heating said toner image such that toner contained in said toner image reaches a softening point or higher thereof.

6. The gloss control method according to claim 5, wherein said gloss control step includes a charging step of charging the surface of said toner image and a heating step of heating said toner image after said charging step.

7. The gloss control method according to claim 6, wherein in said charging step, a corona charger for charging the surface of said toner image without contacting the surface of said toner image is employed.

8. The gloss control method according to claim 6, wherein in said heating step, a light source for radiating infrared rays or far-infrared rays is employed, and said light source heats said toner image without contacting the surface of said toner image.

* * * * *